United States Patent [19]

Straub

[11] 4,252,471

[45] * Feb. 24, 1981

[54] DEVICE FOR PROTECTING PILES

[76] Inventor: Erik K. Straub, Wharf Rd., Tilghman, Md. 21671

[ * ] Notice: The portion of the term of this patent subsequent to Sep. 19, 1995, has been disclaimed.

[21] Appl. No.: 956,609

[22] Filed: Nov. 1, 1978

[51] Int. Cl.[3] ..... E02D 5/60

[52] U.S. Cl. ..... 405/211; 405/217

[58] Field of Search ..... 405/211-216, 405/217

[56] References Cited

U.S. PATENT DOCUMENTS

| | | | |
|---|---|---|---|
| 789,207 | 5/1905 | Cook | 405/211 X |
| 2,817,634 | 12/1957 | McCall | 405/212 X |
| 3,170,299 | 2/1965 | Clarke | 405/61 |
| 3,180,099 | 4/1965 | Mikolajczyk et al. | 405/216 |
| 3,338,058 | 8/1967 | Young | 405/223 |
| 3,370,432 | 2/1968 | Butler et al. | 405/216 |
| 3,807,179 | 4/1974 | Stone | 405/217 |
| 3,831,385 | 8/1974 | Hudson et al. | 405/211 |
| 3,999,399 | 12/1976 | Maurer | 405/215 |
| 4,019,301 | 4/1977 | Fox | 52/725 |
| 4,023,374 | 5/1977 | Colbert et al. | 405/216 |
| 4,114,388 | 9/1978 | Straub | 405/216 |

FOREIGN PATENT DOCUMENTS

| | | | |
|---|---|---|---|
| 338106 | 6/1921 | Fed. Rep. of Germany | 405/212 |
| 806233 | 6/1951 | Fed. Rep. of Germany | 405/212 |

*Primary Examiner*—Dennis L. Taylor

*Attorney, Agent, or Firm*—Oblon, Fisher, Spivak, McClelland & Maier

[57] ABSTRACT

A device for protecting a pile from ice formations collecting on and subsequently extracting the pile as a result of a variation of tide level including a tapered guard member secured to the pile. The tapered guard member is firmly secured to the pile by horizontal stiffening rings and vertical fin members which also serve to prevent deformation of the guard member taper as a result of interaction with the ice formations. The guard member comprises a one piece jacket connected by a vertically extending joint or may comprise a series of tapered strips, a series of interconnected curved sections, or a series of interconnected rectangular ribs.

8 Claims, 17 Drawing Figures

DEVICE FOR PROTECTING PILES

BACKGROUND OF THE INVENTION

1. Field of the Invention

This invention relates generally to a pile protection guard for preventing ice formations from collecting on and subsequently extracting a pile as a result of a variation of tide level.

2. Description of the Prior Art

As noted in U.S. Pat. No. 4,114,388, issued Sept. 19, 1978 to Applicant, severe damage may be caused to timber or tapered section pilings in freezing weather in tidal waters, the reason being that the water freezes and establishes ice formations around the pilings during high tides. As the tide falls or ebbs the ice mass that has formed around the pile is lowered as a result of the falling water level. At low tide the ice freezes in the void area created when the ice mass slides down the tapered pile section, and subsequently, when the tide rises, this ice interreacts with the piling to lift and eventually extract the base of the piling from the hole or bore into which it had been previously driven at the bottom of the water body. During the time periods of constant freezing conditions, the cyclical action of the tide will actually extract the piling completely from the bottom of the water body.

To counteract the adverse effects of ice formations on pilings, many proposed devices have been adapted to pilings with varying degrees of success. However, none of these devices have proven to be wholly successful as well as being of a simple and economical construction.

U.S. Pat. No. 3,170,299 to Clark discloses a device in the form of a sheath situated around a pile in the shape of a cylinder, extending above the high water line and below the point at which ice freezes. An insulating material is carried in a ring at the upper portion of the sheath so that the water contained inside the sheath retains more heat and therefore prevents freezing.

U.S. Pat. No. 3,180,099 to Mikolajczyk et al. discloses a pile protector in the form of a sheath positioned around a pile and containing an inner lining of material having a low friction coefficient. The sheath extends below the point at which ice forms and also above the high water mark. A spring is placed between the top of the sheath and the bottom of the dock and thus, when ice is frozen around the sheath and the tide is rising, the sheath moves upwardly and compresses the spring. Moreover, when the tide lowers, the spring returns the sheath to its original position and therefore, the sheath moves up and down around the pile preventing any upward force on the pile itself.

SUMMARY OF THE INVENTION

It is an object of the invention to provide an effective and economical pile protection device for preventing ice formations from collecting on and extracting a pile.

Another object of the invention is to provide a pile protection device which is easily and effectively secured to a pile and capable of resisting deformation due to interaction with ice formations.

According to the present invention, the foregoing and other objects are attained by providing a pile with a guard member concentrically mounted to and axially extending along the pile such that the guard member is tapered in such a manner that the diameter of the guard member decreases in an upward direction to allow for a vertical displacement of an ice formation relative to the guard member.

BRIEF DESCRIPTION OF THE DRAWINGS

Other objects and many of the attendant advantages of this invention will be readily appreciated as the same becomes better understood by reference to the following detailed description when considered in connection with the accompanying drawings, in which like reference characters designate the same or similar parts throughout the figures thereof and wherein.

DESCRIPTION OF THE PREFERRED EMBODIMENTS

Referring now to FIGS. 1–5B, there is shown a pile protection device 1 which is suitably mounted to a pile 2 and is mounted on the pile 2 by securing members or nails 12. Pile protection device 1 is concentrically mounted to and axially extends along pile 2 and is provided with taper t such that the diameter of pile protection device 1 decreases in an upward direction.

Figure 1:
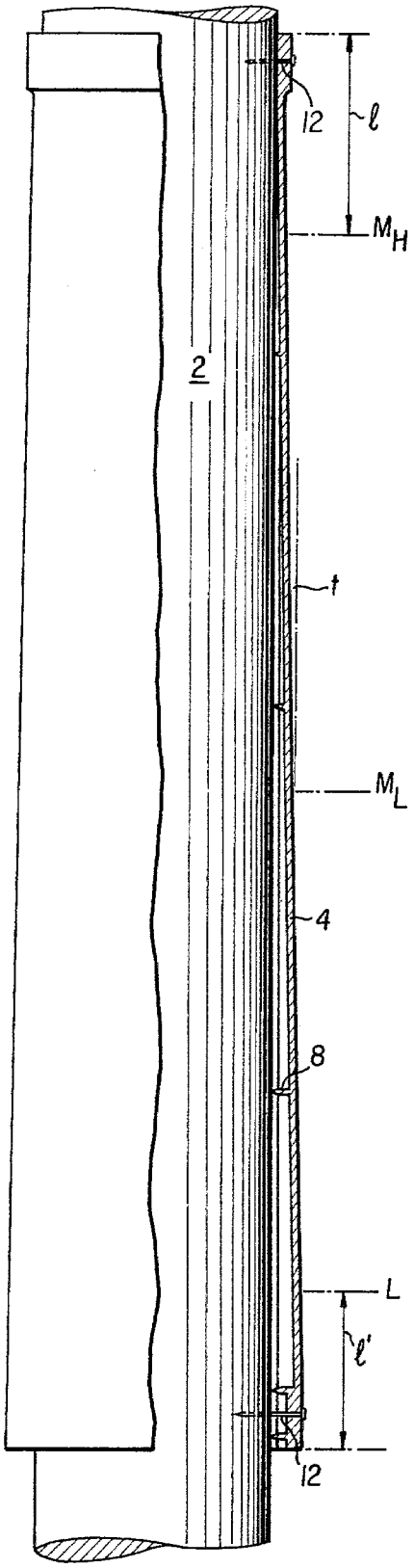
FIG. 1 is a side elevational view in partial cross-section of the pile protection device of the present invention.
Figure 2:
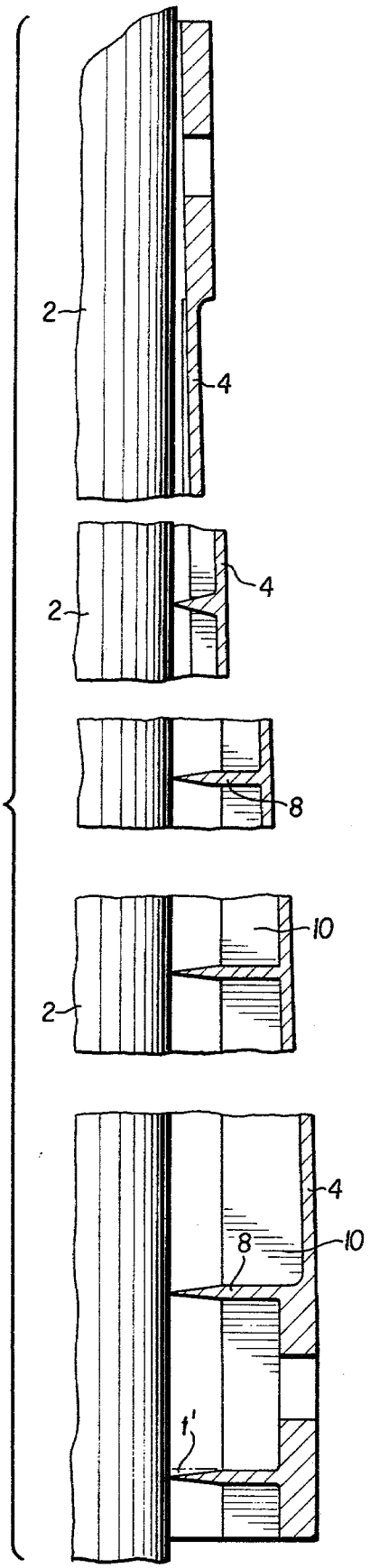
FIG. 2 is a cross-sectional view showing portions of the embodiment of FIG. 1 in greater detail.
Figure 3A:
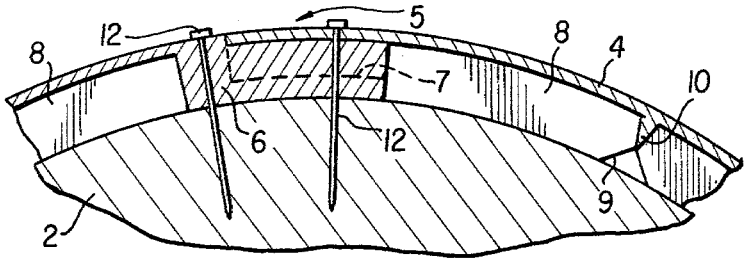
FIG. 3A is a vertical cross-sectional view taken along an upper portion of the embodiment of FIG. 1 at the joint.
Figure 3B:
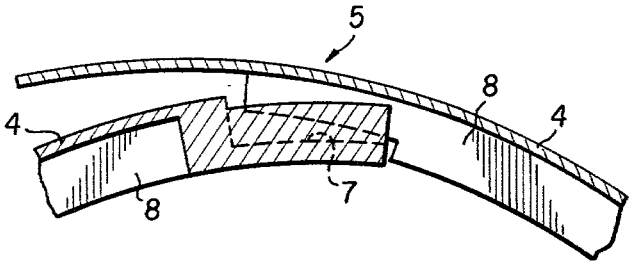
FIG. 3B is a vertical cross-sectional view of the joint member interconnecting end portions of the guard in the assembly process.

Pile protection device 1 can be made in any length insofar as the length is determined by the tidal range in a given geographic area and by the freezing conditions that could be anticipated or taken from historical records. The length of pile protection device 1 is such that the top of the pile protection device is located above mean high water line $M_H$ and, more importantly, the bottom of pile protection device 1 is below the bottom of the ice denoted as reference letter L. The thickness at low tide of the ice formation is represented in FIG. 1 as being that distance between the mean low water line $M_L$ and the bottom of the ice L. Therefore, the top of pile protection device 1 is provided at a distance l above mean high water line $M_H$ while the bottom of the pile protection device is displaced at an appropriate distance l' below the bottom of the ice L. The pile protection device is preferably made with a taper t of approximately $\frac{1}{8}$ inch/foot from top to bottom.

It should be particularly noted that pile protection device 1 can be made in various diameters to suit various size pilings. However, most piling damage due to ice formations is caused to residential or small commercial installations such as yacht clubs, marinas, etc. It is thus anticipated that the normal maximum top diameter of the piling protection device would be approximately 8 to 14 inches.

As shown in FIGS. 1–5B, pile protection device 1 includes a vertically extending one piece jacket 4 which is mounted on the pile 2 and which includes an outside taper t. As best shown in FIGS. 3A and 3B, one edge portion of the one piece jacket 4 is formed with a joint 5 including a thick section 6 molded to one side of the joint 5 and which further includes a notch portion 7 formed in the thick section 6. During assembly of the joint 5, one edge portion of the one piece jacket 4 overlaps the thick section 6 such that a corresponding horizontal stiffening ring 8 is disposed within the notch portion 7. Subsequently, the overlapped one piece jacket 4 is cut away and securing members 12 are driven through the joint 5 so as to secure the one piece jacket 4 to the pile 2 at the joint. The thick section 6 of the one piece jacket 4 at the joint 5 consists of a tapered strip having approximately the same taper as that of the horizontal stiffening rings described hereinbelow.

A series of vertical fins 10 are also provided so as to interconnect the series of horizontal stiffening rings 8 and also connect with one piece jacket 4.

Figure 5A:
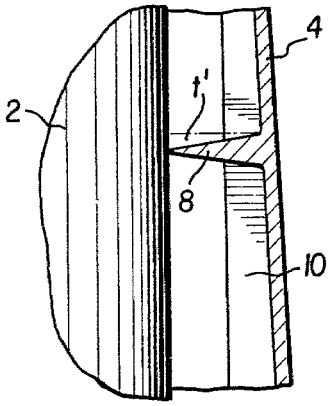
FIGS. 5A and 5B illustrate the horizontal ring in its initially molded shape and the horizontal ring in its compressed state, respectively.
Figure 5B:
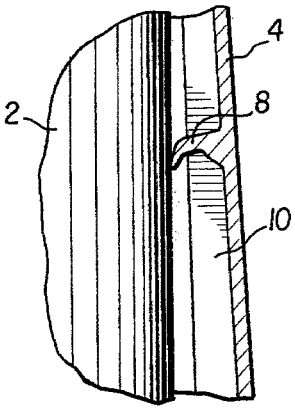
Figure 6A:
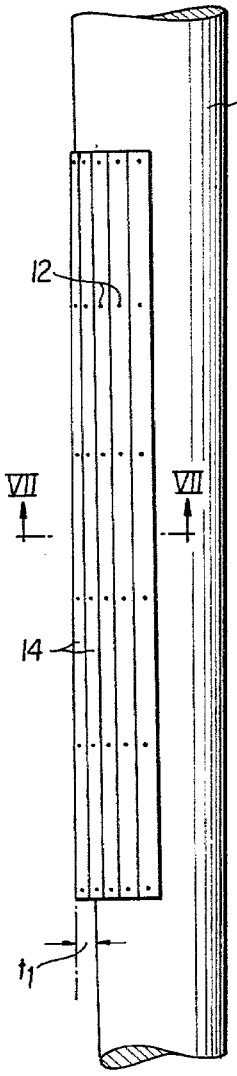
FIGS. 6A and 6B illustrate a partial elevational view and vertical cross-sectional view of a second embodiment of the present invention.

Each of the horizontal stiffening rings 8 are molded so as to form a notch portion 9 at the intersection with vertical stiffening fins 10. Notch portions 9 serve to facilitate mounting of the one piece jacket 4 around the pile 2. The horizontal rings 8 are made of a tapered cross-section t′ which is thicker at the wall portion of the one piece jacket and becomes thinner in a direction towards the pile, as best shown in FIGS. 5A and 5B. When the one piece jacket 4 is mounted around the pile 2. the tapered or thin portion of each horizontal stiffening ring 8 is deformed in either an upward or downward direction and serves to hold the one piece jacket concentrically around the pile.

Figure 4:
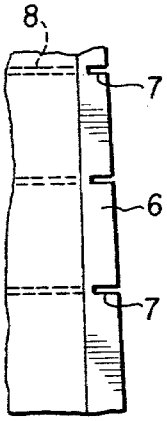
FIG. 4 is an elevational view of the joint member utilized in the embodiment of FIG. 1.

As further shown in FIG. 4, section 6 includes notched portions 7 for interengagement with corresponding horizontal stiffening rings 8.

FIGS. 5A and 5B show, respectively, horizontal ring 8 in its molded shape and upon engagement with pile 2 so as to be compressed and frictionally engaged therewith.

Figure 7A:
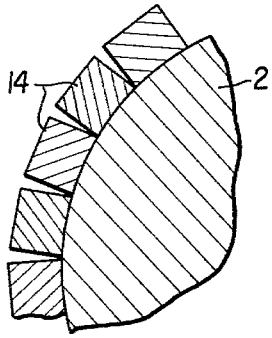
FIGS. 7A and 7B set forth variations in the cross-sectional configuration of the strips set forth in the embodiment of FIGS. 6A and 6B.
Figure 7B:
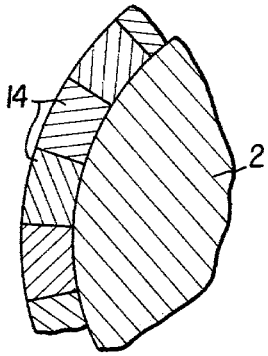
Figure 8A:
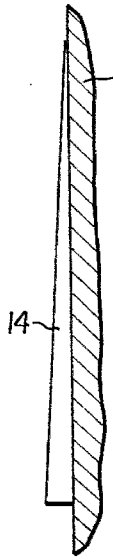
FIGS. 8A and 8B illustrate the taper of the embodiment of FIGS. 6A and 6B.
Figure 8B:
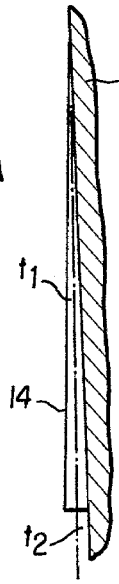

A second embodiment of the present invention is set forth in FIGS. 6A–8B and includes a series of tapered strips 14 which are radially fastened to the pile 2 by securing members 12. The strips 14 can be made with either a single or both outside or outer taper $t_1$ or thinner inside taper $t_2$ which corresponds to the taper of the pile 2, should the same occur. As a result, the total taper of the strips 14 correspond to inner taper formed on the pile 2, as shown in FIGS. 8A and 8B.

As best shown in FIGS. 7A and 7B, the cross-section of the strips can be either rectangular or radially shaped with either configuration preventing the adherance of ice to the pile 2. Furthermore, the strips 14 can be made of any width, however, narrower strips, i.e. one inch to three inches wide, would be the most practical to install. Moreover, the strips 14 can be formed of plastic, vinyl coated wood, or any other suitable material.

Figure 9:
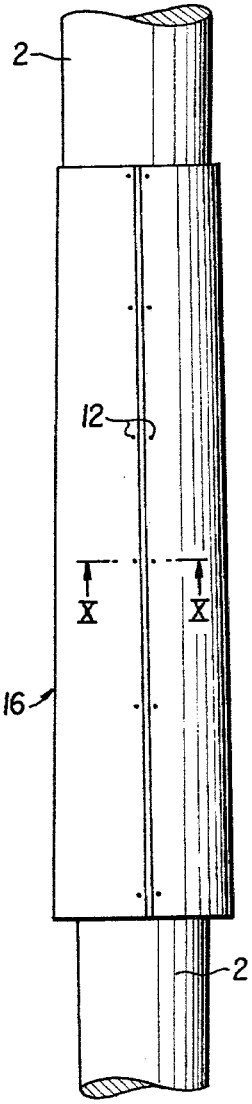
FIG. 9 shows an elevational view of a third embodiment of the present invention.
Figure 6B:
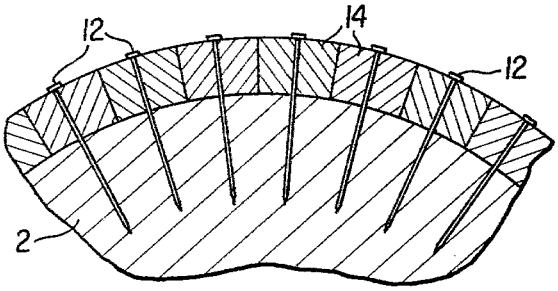
Figure 10:
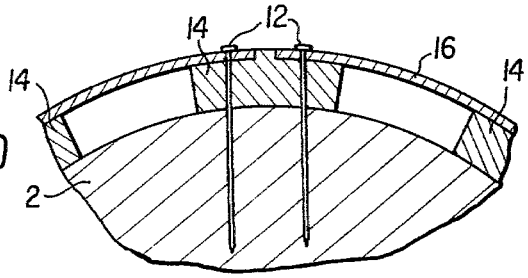
FIG. 10 is a vertical partial cross-sectional view taken along line X—X in FIG. 9.

FIGS. 9 and 10 set forth a third embodiment of the present invention which includes the combination of several strips 14 described in the second embodiment in combination with a plastic jacket 16 surrounding the strips 14 to provide a combined effect of the strips and the protective plastic jacket. The strips 14 in combination with the plastic jacket 16 provide a guard or jacket which allows for water to freeze both in the interior and exterior portion thereof, thus creating a shear plane effect and avoiding deformation due to contact with ice. The plastic jacket 16 can be formed either with the strips 14 attached thereto or with the strips 14 separate with the jacket 16 consisting of a sheet of plastic wrapped around the strips and secured by securing members 12 through the strips 14 into the pile 2. The end portions of the plastic jacket can be either overlapped or can be formed with abutting edge portions so as to provide a relatively smooth exterior surface.

Figure 11A:
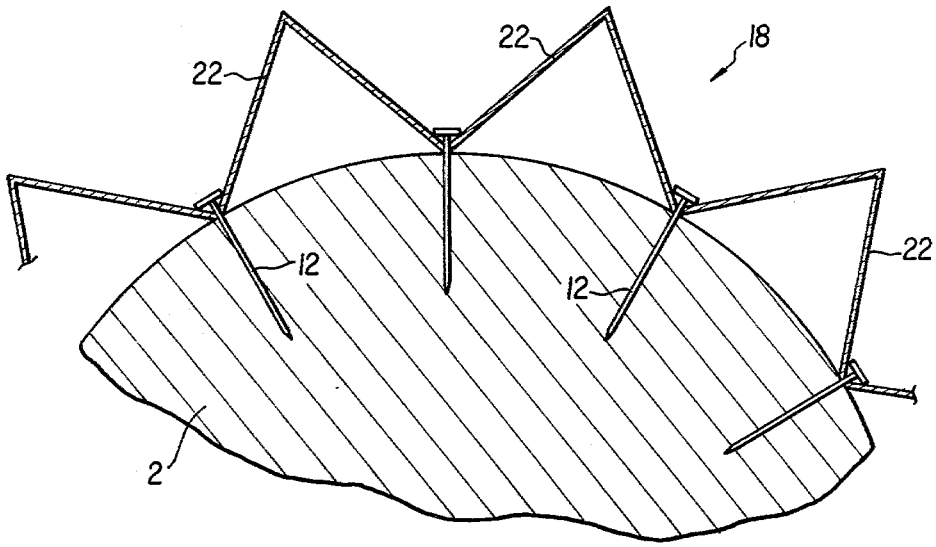
FIGS. 11A and 11B illustrate variation in guard structure of a fourth embodiment of the present invention.
Figure 11B:
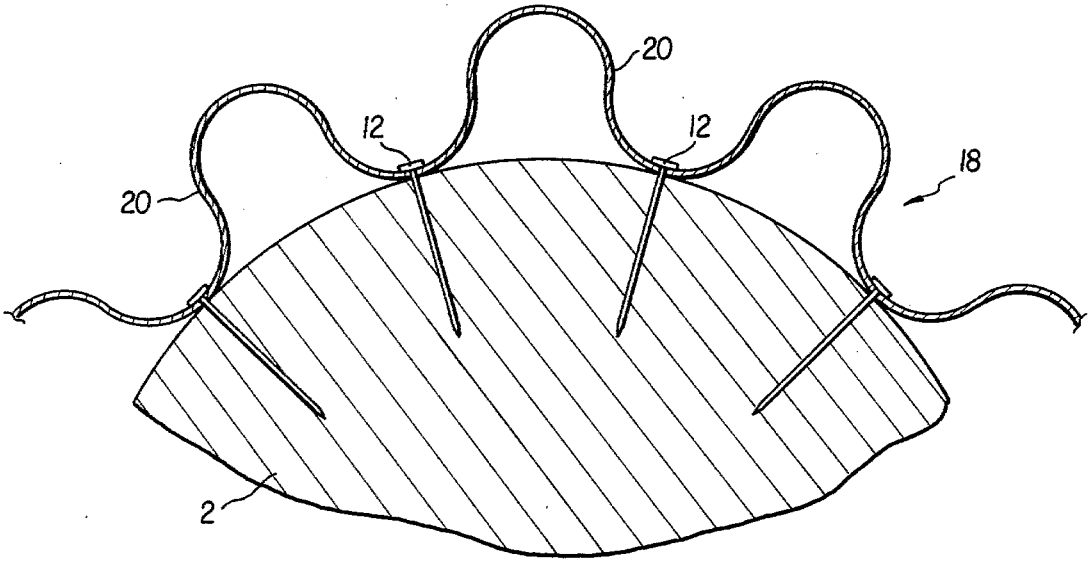

A fourth embodiment of the present invention is set forth in FIGS. 11A and 11B which includes a jacket 18 made of a plastic or vinyl sheet. The jacket 18 can be preformed to either of the shapes shown in the above-noted figures so as to provide curved sections 20 or rectangular, pleated ribs 22. Both the curved sections 20 and ribs 22 are preformed with a taper as described hereinabove so as to provide a tapered or conical effect with regard to the exterior portion of the jacket 18 and, as previously described, a joint interconnecting end portions of the jacket 18 can be either overlapped or in abutting relationship and connected to the pile 2 by securing members 12.

It is also important to note that the second, third, and fourth embodiments can all be made of any required length which corresponds to the principle of the first embodiment. In other words, the length would be the maximum anticipated thickness of the ice plus the maximum anticipated tide range. Furthermore, with the exception of the second embodiment, the principle of operation is the same in each embodiment of the present invention insofar as the ice is allowed to freeze both along the interior and exterior portion of the jacket so as to create a shear plane effect with the plastic jacket which acts as a friction-free surface.

The principle practiced by the present invention is to reverse the taper of the piling by firmly securing a guard section to the piling. Therefore, should an ice formation occur at high tide, when the tide subsequently falls the guard section will force a larger hole in the ice formation around the piling or cause the surrounding ice to bridge. As the ice formation refreezes at low tide and the tide subsequently rises, the ice formation will be prevented from collecting on and extracting the piling since a smaller effective piling cross-sectional area is provided as the ice formation rises with the tide.

Obviously, many modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States of America is:

1. A pile protection for preventing an ice formation from collecting upon and subsequently extracting a pile as a result of a variation of tide level, which comprises:

guard means concentrically mounted to and axially extending along said pile, said guard means being tapered such that the diameter of said guard means decreases in an upward direction to thereby allow said ice formation to be vertically displaced relative to said guard means during said tide level variation whereby said ice formation is prevented from extracting said pile during said tide level variation;

means for firmly securing said guard means to said pile; and stiffening means connected to said guard means at a plurality of points along the length of said guard means and located between and interconnecting said guard means and said pile wherein said stiffening means comprises;

only a plurality of horizontal stiffening rings connected with said guard means; and a plurality of vertical fin members connected to said guard means and interconnecting said horizontal stiffening rings.

2. The pile protection device as set forth in claim 1 wherein said horizontal stiffening rings are unitarily moldably connected to said guard means.

3. The pile protection device as set forth in claim 1 wherein each of said horizontal stiffening rings include deformably tapered end portions for engaging said pile.

4. The pile protection device as set forth in claim 1 which further comprises joint means for interconnecting corresponding end portions of said one piece guard means.

5. A pile protection device for preventing an ice formation from collecting on and subsequently extracting a pile as a result of variation of tide level which comprises:

guard means concentrically mounted to and axially extending along said pile, said guard means being tapered such that the diameter of said guard means decreases in an upward direction to thereby allow said ice formation to be vertically displaced relative to said guard means during said tide level variation whereby said ice formation is prevented from extracting said pile during said tide level variation; and means for firmly engaging said guard means to said pile wherein said guard means comprises a plurality of tapered strips.

6. The pile protection device as set forth in claim 5, wherein said guard means further comprises a jacket member mounted on the circumferential surface of said tapered strips.

7. A pile protection device for preventing an ice formation from collecting on and subsequently extracting a pile as a result of variation of tide level, which comprises:

guard means concentrically mounted to and axially extending along said pile, said guard means being tapered such that the diameter of said guard means decreases in an upward direction to thereby allow said ice formation to be vertically displaced relative to said guard means during said tide level variation whereby said ice formation is prevented from extracting said pile during said tide level variation; and means for firmly securing said guard means to said pile wherein said guard means comprises a series of interconnected curved sections.

8. A pile protection device for preventing an ice formation from collecting on and subsequently extracting a pile as a result of variation of tide level, which comprises:

guard means concentrically mounted to and axially extending along said pile, said guard means being tapered such that the diameter of said guard means decreases in an upward direction to thereby allow said ice formation to be vertically displaced relative to said guard means during said tide level variation whereby said ice formation is prevented from extracting said pile during said tide level variation; and means for firmly securing said guard means to said pile wherein said guard means comprises a series of interconnected rectangular ribs.

* * * * *